United States Patent [19]

Brower

[11] 4,413,450

[45] Nov. 8, 1983

[54] ROOF CURB ADAPTER

[76] Inventor: Gary M. Brower, 2311 East 28 St., Chattanooga, Tenn. 37407

[21] Appl. No.: 282,658

[22] Filed: Jul. 13, 1981

[51] Int. Cl.[3] ..... E04F 19/00; E04H 14/00

[52] U.S. Cl. ..... 52/27; 52/173 R

[58] Field of Search ..... 52/18, 19, 27, 72, 199, 52/200, 173 R

[56] References Cited

U.S. PATENT DOCUMENTS

| | | | |
|---|---|---|---|
| 1,469,321 | 10/1923 | Kramer | 52/200 |
| 2,021,675 | 11/1935 | Tatum | 52/18 |
| 3,399,500 | 9/1968 | Shapiro | 52/72 |
| 3,455,073 | 7/1969 | Kiekhaefer | 52/200 |
| 3,521,414 | 7/1970 | Malissa | 52/200 |
| 4,197,682 | 4/1980 | Schiff et al. | 52/72 |

*Primary Examiner*—Peter M. Caun
*Attorney, Agent, or Firm*—Alan Ruderman

[57] ABSTRACT

An adapter for use with a base curb for matching selected roof-top equipment to the curb without any field modification so that when the roof-top equipment needs of the building become known the adapter and roof-top unit may be installed. This eliminates roof integrity and leakage problems. The adapter is a substantially box member having a base positionable upon the roof curb and having an open frame positioned above the base. Inclined surfaces interconnect the base with the open frame. Channel members beneath the inclined surfaces add further rigidity to the adapter. The interior portions of the adapter include insulation so that condensation problems are eliminated.

8 Claims, 4 Drawing Figures

ROOF CURB ADAPTER

BACKGROUND OF THE INVENTION

This invention relates to roof mounted structures and more particularly to a roof curb adapter for joining roof-top equipment to a base curb.

On buildings having a built-up roof, i.e. a roof of asphalt, tar paper, etc., roof integrity problems occur when roof-top equipment such as heating, ventilating and air-conditioning equipment have been installed subsequent to the construction of the roof. When, for example, the equipment size cannot be determined before the roof is constructed, finished roofs in the prior art originally had to be cut at a later time for receiving the equipment. Obviously cutting through the roof reduces substantially the structural integrity of the roof and, in spite of flashing, results in leakage problems.

To improve this situation, the prior art has provided in metal roof frame structures such as in industrial buildings and shopping centers, a metallic box-like structure having a flat platform, known as a roof curb, which is installed on the roof during initial roof construction and thereafter when the roof is built-up becomes a permanent part of the roof. However, when the size of the roof-top equipment is unknown at the time of roof construction, problems still exist when use is made of such roof curbs. For example, if the required roof-top unit is larger than initially expected, the curb platform either has to be cut bigger or the platform and/or curb itself torn out completely, thereby penetrating the integrity of the roof. If the unit is smaller than originally anticipated, the curb platform must be modified by "jury rigging" at the site at relatively large cost—usually by unskilled workers, subsequently resulting in leakage problems. A similar situation results when, for example, one tenant in a shopping mall moves and a later tenant having a greater heat load requires a larger roof-top air conditioning unit, the prior art curb platform had to be cut or the platform and/or curb replaced thereby compromising the integrity of the roof, resulting in eventual leakage problems. If the later tenant requires a smaller unit, the curb platform must be modified, ensuring eventual leakage problems. Moreover problems are encountered with the prior art curbs since they lack water run-off provisions because the curbs had to have substantially flat platforms for directly carrying the roof-top equipment. Furthermore, the prior art constructions are such that the curb platform greatly sags when carrying the load of the roof-top unit and this is aggravated further when additional loads such as snow accumulation occur. The inherent lack of rigidity of the structure effects a rapid deterioration of integrity of the unit further resulting in leakage problems.

SUMMARY OF THE INVENTION

Consequently, it is a primary object of the present invention to provide apparatus for maintaining roof integrity on building structures where roof-top equipment size cannot be determined before the roof is installed.

It is another object of the present invention to provide an adapter for matching a roof curb with later acquired roof-top equipment thereby effecting an integral roof structure.

It is a further object of the present invention to provide an adapter frame securable to a roof curb and upon which roof-top equipment may be positioned and secured without any field modification to the roof or curb.

It is a still further object of the present invention to provide an adapter for sizing a roof curb to roof-top equipment, the adapter having water run-off provisions and large load carrying capacity.

In accordance with these objects the present invention provides an adapter for use with a base curb unit for matching selected roof-top equipment to the curb without any field modification. A base curb of selected capacity range is flashed into the roof during initial construction and at a later date when the equipment needs become known the adapter is installed on the base curb to match it to the required roof-top unit.

The adapter is a substantially box design having a bottom border positionable on the upper border of the base curb to which it is thereafter secured, and having an upper border about an aperture matched to the roof-top unit which is then fastened to the adapter. The adapter includes inclined or sloped upper surfaces extending from adjacent the lower border to the upper border to provide run-off capability and added strength and rigidity for supporting the matched roof-top unit without deflection. Additional structural members are connected within the adapter to the upper surface to provide additional strength and insulating material is provided on the inside about the inclined upper surfaces and the upper border.

The invention ensures that the integrity of the roof is maintained by eliminating the need to cut into the finished roof or into the roof curb. This, moreover, results in substantial cost savings. No additional flashing or field modifications are required when installing the roof-top equipment, thus eliminating leakage and condensation problems of the prior art.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
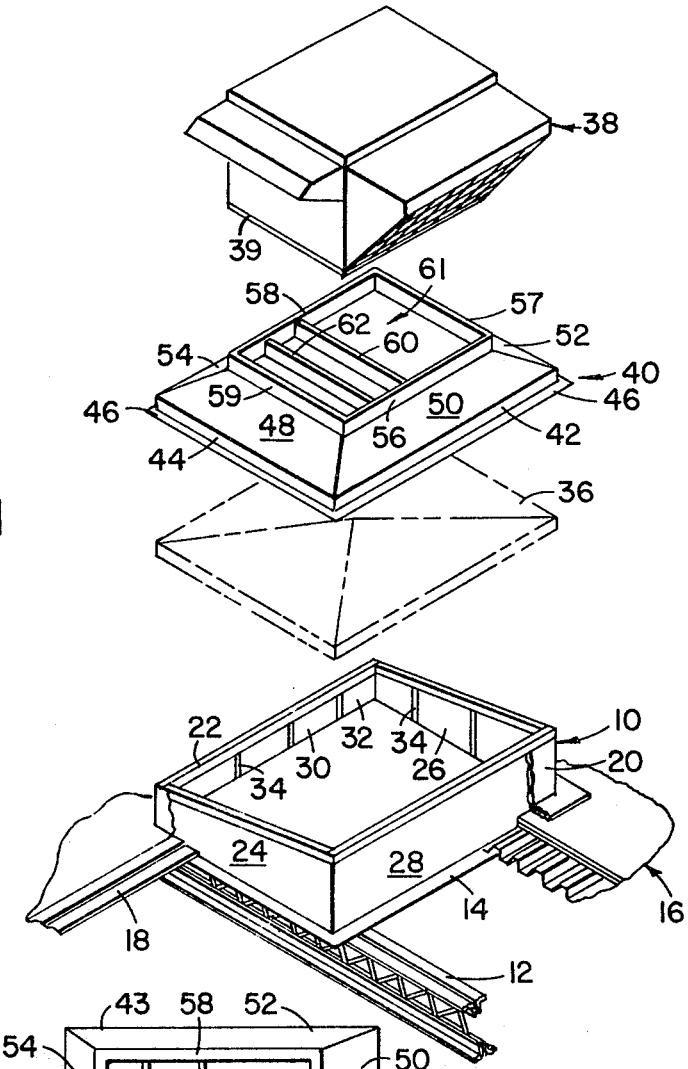
FIG. 1 is a disassembled perspective view illustrating the base curb, the adapter and a roof-top air conditioning unit, and further illustrates a temporary curb cover in phantom.
Figure 2:
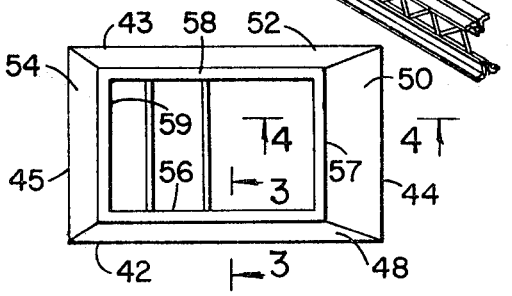
FIG. 2 is a top-plan view of the adapter illustrated in FIG. 1.

Referring now to the drawings, and particularly to FIG. 1, a base curb unit 10 is illustrated positioned on spaced roof joists 12 (only one of which is illustrated). The curb is a substantially box-shaped rectangular galvanized steel structure having a lower peripheral lip 14 extending therefrom which is positioned on the joists and is secured on the roof as the roof is built-up by the roof structure illustrated generally at 16 and 18 and sealed thereto by means of flashing 20. Thus, the base curb when so installed becomes a permanent part of the roof structure. Wood nailing strips 22 are fastened about the upper border of the base curb, the upper surface of which should be substantially horizontal. Thus, the sides of the base curb 24, 26 and 28, 30 are sized and shaped to provide a level upper peripheral surface. If a roof has sloped configuration then the sides 24, 26 would also be sloped as illustrated. Similarly if the roof has a double sloped configuration then the sides 28, 30 would also be sloped. Disposed on the inner surface of the walls 24,26, 28 and 30 is fiber glass insulation 32 and support braces 34 are overlayed thereon.

After the curb is installed a temporary curb cover 36 may be positioned about the top periphery to seal the opening until the adapter frame and roof-top unit are installed. The temporary cover 36 is merely a closure member which may be nailed temporarily to the wood strips 22. In the prior art a curb platform having a construction similar to this temporary curb cover would directly support a roof-top unit such as air conditioning unit 38. The platform had to have an opening corresponding to the air conditioning inlet and outlet and as aforesaid when the size of the unit was initially unknown great problems resulted in modifying the openings of the platform to the unit.

In accordance with the present invention roof integrity is maintained and cost reduced by the utilization of an adapter frame 40. The adapter is of a substantially box construction formed from galvanized steel having opposite pairs of lower upstanding wall portions 42, 43 and 44, 45 forming a bottom border, each of the wall portions 42, 43 being substantially 90 degrees to the wall portion 44, 45 such that the bottom border is of substantially the same rectangular form at the upper peripheral surface of the nailing strips 22 of the base curb 10, but slightly larger so as to fit about and abut the outer surfaces thereof. At their lowermost ends the wall portion 42–45 have an inclined lip 46 which extends away from the wall surfaces 22, 24, 26, 28 of the base curb and thereby directs any water run-off away from the base curb.

Extending from the upper edge of each of the wall portions 42–45 is an upwardly sloped surface 48, 50, 52, 54, each of which connects the respective wall portion to a respective upper upstanding wall portion 56, 57, 58, 59 forming the peripheral border about an aperture 61. The size of the aperture 61 is adapted for the particular roof-top unit 38 to be installed on the roof curb, the unit 38 having a support pedestal 39 through which the air flows and which is positioned on the top of the walls and overlies the exterior of the wall surfaces 56–59, the aperture cooperating with the air inlet and outlet openings of the unit 38 for receiving duct work. Cross-channel members 60, 62 are disposed across the aperture 61 as required for the unit 38. It is desirable that the slope of the surfaces are approximately one half inch to the foot, but the actual slope depends upon the size of the base curb installed and the size of the unit 38 selected. The slope not only provides water and snow run-off but adds strength to the system since the vertical load of the unit 38 is split into vertical and horizontal components. This is an extremely important aspect of the present invention and avoids the prior art problems of deflection and eventual leakage.

Figure 3:
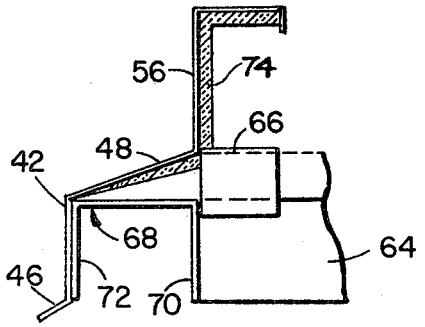
FIG. 3 is a vertical cross-sectional view taken substantially along line 3—3 of FIG. 2.
Figure 4:
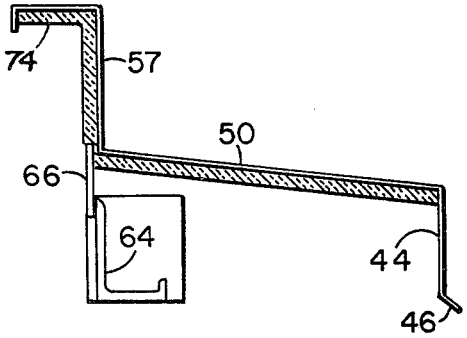
FIG. 4 is a vertical cross-sectional view taken substantially along line 4—4 of FIG. 2.

As illustrated in FIGS. 3 and 4 the interior of the adapter frame is additionally braced by channel members such as "J" channels 64 extending lengthwise substantially parallel to the walls 44, and 45. The channels 64 are welded to short lengths of connector plates 66 which in turn are welded to the interior of the adjacent upper wall surfaces 57, 59. A substantially C-shaped clip 68 is welded at one leg 70 to each end of each channel 64 and the respective opposite leg 72 of the clip is welded to the adjacent lower upstanding wall 42, 43 thereby providing a rigid adapter frame structure. The C-clip 68, when the adapter is positioned on the base curb, is disposed about the cooperating wall 28, 30 of the curb and the frame at the walls 42–45, is then nailed to the nailing strips 22. The adapter frame also includes fiber glass insulation 74 along the interior of the walls 56–59 and the top surface and the interior of the sloped surfaces 48, 50, 52, 54.

Thus, it should be understood that when a built-up roof is constructed a base curb is selected that is sized according to desired acceptable equipment brands and capacity ranges. The curb is flashed-in during roof construction and the temporary cover is attached. Then, when the heating, ventilating and air conditioning equipment is later selected, an appropriate adapter is installed merely by nailing, no field modification or additional flashing being required. The heating, ventilating, air conditioning unit is thereafter positioned on and secured to the adapter.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. An adapter for use in combination with a roof curb for supporting a roof-top environmental control unit on the roof of a building, said roof curb being fastened to the roof and having a substantially box-shaped open top configuration including upstanding walls interconnected together to form a substantially horizontally disposed top border defining the open top, said roof-top unit including a support pedestal through which environmentally conditioned and return air flows, said adapter adopted to be interposed between said curb and said unit and comprising a base positionable upon said top border of the roof curb and having downwardly extending wall portions enveloping said border, an open frame for ingress and egress of air disposed above said base and having upstanding wall means for forming an upper peripheral edge on which said roof-top unit support pedestal is disposed, inclined surfaces fixed to and interconnecting said base with said upstanding wall means below said peripheral edge, said inclined surfaces being interconnected together to form a continuous surface, means for securing the pedestal of said roof-top unit to said peripheral edge, and means for securing said downwardly extending wall portions to the border of said roof curb.

2. In the combination as recited in claim 1, wherein said upstanding wall means is receivable within the pedestal of said roof-top unit.

3. In the combination as recited in claim 2, including channel members, means for fixedly securing said channel members to part of said upstanding wall means and part of said downwardly extending wall portions.

4. In the combination as recited in claim 2, wherein said adapter is substantially rectangular in plan, each downwardly extending wall portion being interconnected by an inclined surface to a respective upstanding wall means.

5. In the combination as recited in claim 4, including a pair of spaced channel members, means for fixedly securing each channel member to one of a pair of spaced upstanding wall means, and means for connecting each channel member to a respective downwardly extending wall portion corresponding to the other pair of upstanding wall means.

6. In the combination as recited in claim 5, wherein said means for connecting each channel member to a respective downwardly extending wall portion comprises a substantially C-shaped clip means, each clip means having one leg secured to one end of a channel member and having an opposed leg secured to a downwardly extending wall portion, each pair of spaced legs being sandwiched about an adjacent wall of the roof curb when said adapter is disposed thereon.

7. In the combination as recited in claims 2 or 4, including insulation secured to the interior of said upstanding wall means and inclined surfaces.

8. In the combination as recited in claim 1, wherein the free ends of said downwardly extending wall portions include a lip inclined downwardly away from the border of said roof curb.

* * * * *